United States Patent [19]

Lyons

[11] 4,278,252

[45] Jul. 14, 1981

[54] BALL AND PADDLE GAME AND EXERCISE APPARATUS

[76] Inventor: Robert A. Lyons, 295 Tucson St., Aurora, Colo. 80012

[21] Appl. No.: 126,669

[22] Filed: Mar. 3, 1980

[51] Int. Cl.[3] ..... A63F 7/00

[52] U.S. Cl. ..... 273/118 R

[58] Field of Search ..... 273/85 R, 118 R, 118 A, 273/123 R, 123 A, 126 R, 126 A

[56] References Cited

U.S. PATENT DOCUMENTS

| | | | |
|---|---|---|---|
| 1,144,112 | 6/1915 | Denny | 273/85 R |
| 2,688,484 | 9/1954 | Garber | 273/118 R X |
| 2,794,639 | 6/1957 | Christian | 273/123 R |
| 3,120,391 | 2/1964 | Fletcher | 273/126 R X |
| 3,228,688 | 1/1966 | Dennison | 273/85 R |
| 3,287,018 | 11/1966 | Bosch | 273/85 R |
| 4,032,150 | 6/1977 | Wilson | 273/126 R |

*Primary Examiner*—Anton O. Oechsle
*Attorney, Agent, or Firm*—Klaas & Law

[57] ABSTRACT

A game apparatus for two players wherein each player stands at an opposite end of a playing surface with two paddles and tries to hit a steel ball through his opponent's goal. The apparatus comprises the planar playing surface; a support for the playing surface to position it at about elbow height; retaining walls about the playing surface; goal boards defining goal openings; and a transparent shield to protect players from the steel ball.

7 Claims, 3 Drawing Figures

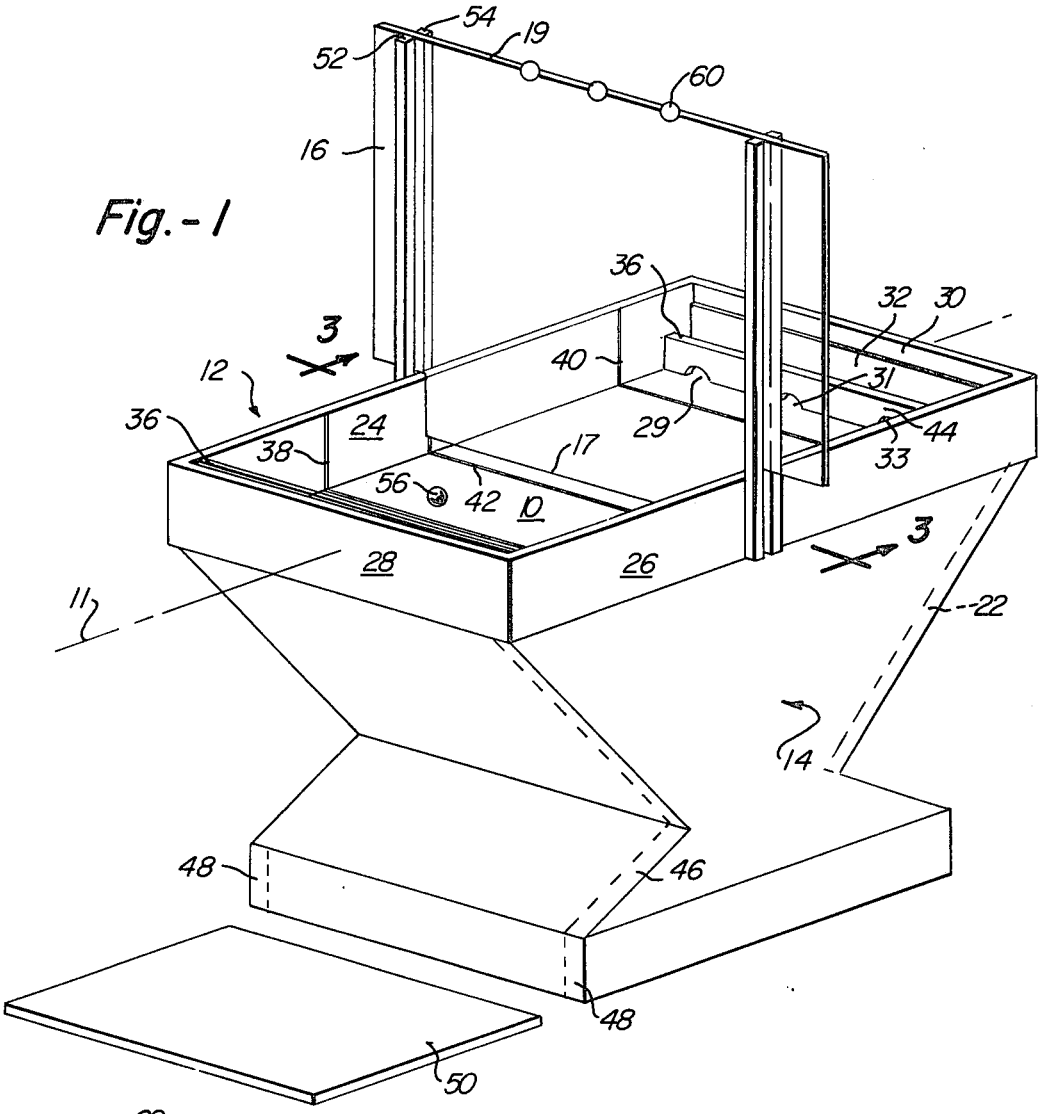
Fig.-1
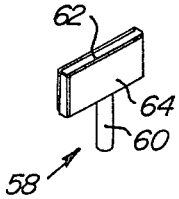
Fig.-3
Fig.-2
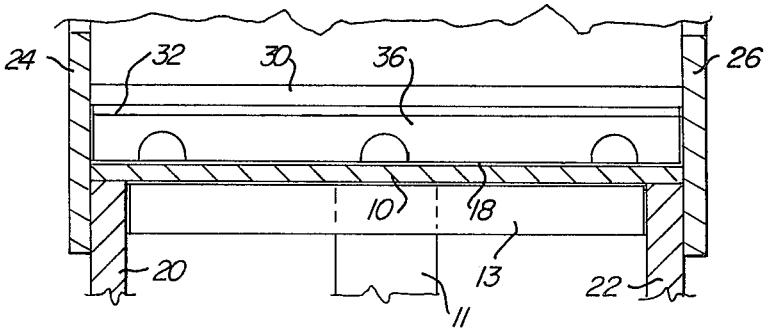

BALL AND PADDLE GAME AND EXERCISE APPARATUS

BACKGROUND OF THE INVENTION

1. Field of the Invention

The present invention relates to games and, more particularly to board, ball, and paddle games.

2. Prior Art

Numerous games are known which, like ping pong, involve the use of a rectangular playing surface and wherein opposing players stand or sit at opposite ends of the playing surface to receive and return a ball towards each other.

Games of this nature are described, for example, in Barlow U.S. Pat. No. 3,992,006, issued Nov. 16, 1976, Wilson U.S. Pat. No. 4,032,150, issued June 28, 1977, and Christian U.S. Pat. No. 2,794,639, issued June 4, 1957. These prior art games have been constructed with a variety of objects in view, such as catching and shooting a rolling ball with a projection device, as in Barlow, sliding a puck in an open tray, as in Wilson, and driving a wooden ball under a barrier and into a goal, as in Christian.

An object of the present invention is to provide a game appartus which permits the players to vigorously use both arms and upper body movement in a fast-paced game.

Another object of the present invention is to provide a game which is vigorous and fast-paced yet relatively safe for the players.

Another object of the present invention is to provide a sturdy amusement device which may be used in a commercial setting without injury to the device.

SUMMARY OF THE INVENTION

The foregoing and other objects are accomplished by the present invention, which, in its preferred embodiment, comprises: a generally rectangular, planar playing surface rigidly supported by a trapezoidal stand which provides means for supporting the playing surface in a fixed position at approximately the elbow level of the players; retaining means about the periphery of the planar playing surface for retaining thereon a rolling, relatively dense ball; goal boards at each end of the planar playing surface, defining a plurality of goal openings though which the ball may pass to score a goal; and a transparent shield extending across the playing surface midway betwen the goal boards, permitting the ball to roll underneath, but shielding players from balls which leave the playing surface.

The relatively dense ball, a one inch steel ball bearing or the like, is propelled by opposing players towards the goal board at the opposite end of the playing surface from which the player propelling the ball is standing. Each player holds a wooden paddle in each hand to propel the ball. Each wooden paddle is constructed with a handle portion and a striking portion adapted to be slid along the playing surface. Each paddle is also provided with an impact-absorbing surface which enables the ball to be propelled with geater control.

The width of the playing surface is such that a player may place the paddle at the sides of the playing surface to strike the ball by extending his arms slightly outwardly. The construction of the goal openings is such that a player may not cover all of the goal openings at a single time.

Thus, in play, two players, each holding two wooden paddles, stand at either end of the playing surface, behind one of their respective goal boards. The ball is rolled back and forth between the players as the players strike the ball with one of their paddles by sliding the paddle along the playing surface, and the ball rebounds from the retaining means and/or the goal board. Thus, in play, the ball develops a considerable amount of speed and momentum. The players rapidly move from side-to-side and move their paddles to strike the ball as it rebounds from the retaining means and goal boards. The object of the game is to hit the ball through the opponent's goal opening. Should a rapidly moving ball leave the playing surface, the transparent shield prevents the ball from striking the opposing player.

The present invention also contemplates goal detecting means which may take the form of an elongated member positioned behind the goal openings so that a ball passing through one of the goal openings strikes the elongated member to produce an audible sound.

The goal board may be provided with elastomeric strips for actively rebounding a ball striking one of the goal boards.

BRIEF DESCRIPTION OF THE DRAWING

FIG. 1 is a perspective view of a game apparatus according to the present invention;

FIG. 2 is a partial sectional view taken along line 3—3 to conform to the drawing of FIG. 1; and FIG. 3 is a perspective view of a paddle according to the present invention.

DESCRIPTION OF THE PREFERRED EMBODIMENT

Referring now to FIG. 1, the present game apparatus may be seen to comprise, in general, a playing surface 10 bounded by retaining means 12, supported on a trapezoidal stand 14, and divided lengthwise by a transparent shield 16.

CONSTRUCTION

The playing surface 10 is approximately 73" in overall length and 37" in overall width. As shown in FIG. 2, the playing surface 10 is essentially planar and is covered with a thin plastic coating 18, such as $\frac{1}{8}$" plastic paneling. The playing surface 10 is constructed from three 2"×12" boards placed side-by-side and cut to length. The boards are supported by cross-braced 2×4's 20, 22 comprised in the trapezoidal stand 14. The boards are further supported by a center post 11 supporting the center 2×12 and having fixed thereto cross braces 13 extending the width of the playing surface.

The retaining means 12 comprise a pair of side rails 24, 26 affixed lengthwise and perpendicular to the playing surface 10. The side rails 24, 26 are each constructed from a 2"×7" board and extend about $3\frac{1}{2}$" above the playing surface 10. The side rails are also covered with a thin plastic coating, similar to that used on playing surface 10. At each end of the playing surface 10, an end member 28, 30 is affixed to the ends of the boards of the playing surface 10 and to the ends of the side rails 24, 26. Each end member is a 2"×7" board extending about $3\frac{1}{2}$" above the playing surface 10. A steel plate 32 is attached to each end member 28, 30, runs approximately the length member, and extends about 3" above the playing surface.

The playing surface 10 is further characterized by a pair of goal boards 34, 36, serving lines 38, 40, and a foul line 42. Each goal board 34, 36 extends between the parallel side rails 24, 26 perpendicularly to the longitudinal axis 11 of the playing surface 10. Each goal board is located about 6" from one of the end members 28, 30, and is constructed from 2"×3½" lumber cut to length. Each goal board has cut therethrough three semi-circular openings 29, 31, 33 2¼" in diameter, one opening 31 being located on the longitudinal central axis 11 the other openings being located about 4" inwardly of a side rail 24, 26. The surfaces of the goal boards 34, 36 opposite the end members 28, 30 are each covered with an elastomeric strip 44 constructed from ¼" thick gum rubber. The gum rubber is depressed by ball impact and, without significant energy absorption, quickly returns to shape thus actively rebounding a ball striking one of the goal boards. Gum rubber is particularly suited to the present apparatus due to its particularly resiliency and toughness. A serving line 38, 40, is painted on the side rails 24, 26 and on the playing surface 10 parallel to each goal board 34, 36 and about 7½" therefrom. The foul line 42 is painted on the side rails 24, 26 and playing surface 10 midway between the goal boards 34, 36 and directly underneath the transparent shield 16.

The trapezoidal stand 14 and center post 11 provide support means for rigidly supporting the playing surface 10 in a fixed position at approximately the elbow level of the players and is trapezoidal in shape to permit free movement of the players without interference by the stand. The trapezoidal stand 14 comprises two 2×4's 20, 22 attached to one end of the playing surface 10 and the corresponding 2×4's (not shown) which are inwardly angled towards the foul line 42 and extend parallel to the side rails 24, 26 for a distance of approximately 3 feet. Approximately 1 foot from the bottom of each 2×4, and angled brace, as shown at 46, is fixed to the 2×4 and extends longitudinally outwardly therefrom to support the 2×4. The 2×4's, 20, 22 and the angled braces 46, rest on horizontal joists 48, of 2"×4" lumber, which in turn rest on the floor.

To accommodate players of various heights, a platform 50, constructed of 2×4's or the like, may be provided for a player to stand on.

The transparent shield 16 is constructed from a sheet of clear, impact resistent material, such as LEXAN brand polycarbonate sheet ¼" thick, as manufactured by General Electric Company. It is important that the shield 16 be sturdy and shatterproof, in order to withstand impact from a rapidly moving metal ball. The sheet is mounted with its lower, linear edge 17 approximately 1¾" above the playing surface 10 and is supported by uprights 52, 54 on each side of the playing surface, which sandwich the shield and are affixed to the side rails 24, 26. The transparent shield 16 extends to an upper edge 19 about 3 feet above the playing surface and slightly outwardly beyond the width of the playing surface. The transparent shield may be from about 18 inches to about 4 feet in height, as long as it serves to block balls travelling off the playing surface and to protect opposing players from such balls.

The above-described apparatus is designed for use with a relatively dense ball 56, preferably a 1" steel ball bearing.

Referring now to FIG. 3, there is shown a paddle 58 foruse with the present apparatus. Each paddle 58 comprises a handle portion 60 and a striking portion 62 affixed to the handle portion. The striking portion 62 is generally rectangular, approximately 5¼" across, and approximately 3¼" high. A ⅛" thick rectangular piece of leather 64 is mounted on each face of the striking portion 62. Each player uses two paddles 58, grasping the handle portion 60 so that the striking portion 62 extends below the player's hand. The lower surface of the striking portion 62 is linear so that the paddle 58 may be slid along the playing surface 10.

OPERATION

In operation, the playing surface 10 and side rails 24, 26, with their thin plastic coatings 18, provide an energy-absorbing surface on which the ball may roll, in the case of the playing surface, or carom off, in the case of the side rails, without excessive bounce when struck by a paddle 58. The depressable leather covering on the paddle 58 allows the ball 56 to make a transitory depression in the paddle 58 so that the paddle 58 may be used to control or angularly direct the ball 56. The retaining means collectively retain the rolling and bouncing ball 56 on the playing surface 10. The trapezoidal stand 14 rigidly supports the playing surface during the stress and forces of play. The transparent shield 16 protects players from a ball 56 which leaves the playing surface 10, yet permits the ball 56 to pass underneath the transparent shield 16 when the ball is on or in the vicinity of the playing surface 10 and permits players to view the ball through the shield anywhere on the playing surface. The steel plate 32 provides an audible noise when a ball 56 passes through a goal opening to strike the steel plate 32. The goal boards 34, 36 provide the goal openings used in scoring during play of the game and the elastomeric strips 44 on the goal board provide a lively rebound to a ball striking a goal board 34, 36.

PLAY OF THE GAME

The preferred method of use of the above-described apparatus is in a game according to the following rules.

The game is begun by the first serve. The first serve is determined by a coin toss or by a challenger. Once the serve is determined, the serve is set up when one player places the ball behind a serving line 38, 40 and taps the ball towards an opposing player, the opposing player returns the ball behind the serving line, and the initial player again strikes the ball. Failure of the opposing player to return the initial hit beyond the server's serving line, results in a "free-shot", as described below. Once the ball is served, each player tries to direct the ball with one of the player's two paddles into a goal opening of the opposing player. As a volley progresses, the speed and directions of the ball will rapidly increase. Naturally, due to the size and construction of the present apparatus, the players will move from side-to-side and rapidly extend each arm to slide a paddle along the playing surface to contact the ball.

Once play has begun, a player may not stop the forward motion of the ball with the back of his paddle after it has rebounded off of his goal board or once he has initiated forward motion of the ball with one of his paddles. A violation of this rule results in a free shot for his opponent.

If, at any time during play, a player hits the glass with his hand or paddle, it is considered crossing the foul line and results in a free shot for his opponent.

Once the ball crosses the foul line into a player's side, that player must attempt to return the ball within three seconds or receive a free shot penalty. Once the ball has made contact with either of the player's paddles, he must put the ball in forward motion in an attempt to cross the foul line within two seconds or receive a free shot penalty. If a ball strikes the transparent shield and drops back onto the playing surface, the two second time period again begins.

When a ball is hit off the table by a player attempting to move the ball forward, the player hitting the ball off the table receives a modified free shot penalty.

In the free shot penalty, the player making a free shot against his penalized opponent replaces the ball behind his serving line and shoots at his opponent's goal. The opponent cannot block the shot until it has rebounded off his goal board and the ball is in play. When the ball has rebounded off the goal board, the defending player may stop the ball once with the back of his paddle and then put the ball in play. If the opponent blocks the free shot, an automatic free point is scored for the player executing the free shot. In the case of the modified free shot, the defending player may block the shot but not stop the ball as it rebounds off the goal board.

Thus there has been described a game apparatus which provides vigorous exercise in a competitive context between two players in a fast-moving game. While the present invention has been described with reference to a particular and presently preferred embodiment thereof, it is to be understood that numerous variations may be contemplated within the scope of the present invention. For example, variations of ball size, goal size, board size, etc., are possible within the functional limitations described for these elements. The ball may be of a dense material other than steel, such as ceramic. Goal lights 60 may be provided to electronically indicate the scoring of a goal by connection to microswitches behind the goal openings, or to keep score through appropriate counting circuitry.

What is claimed is:

1. Game apparatus for two players comprising:

a planar playing surface having a predetermined length and width within which a relatively dense ball is put in play;

support means for rigidly supporting said playing surface in a fixed position at approximately elbow level of said players;

retaining means, on the periphery of said playing surface retaining the ball on said playing surface;

a pair of spaced apart goal boards extending along the width of said playing surface for deflecting said ball when said ball strikes one of the goal boards;

said goal boards defining a plurality of goal openings through which said ball may pass; and a transparent shield extending across the playing surface midway between said goal boards and extending in height from a lower edge above said playing surface a distance slightly greater than the diameter of said ball to an upper edge from about eighteen inches to about four eet from the playing surface.

2. The apparatus of claim 1 further comprising goal detecting means associated with said goal openings.

3. The apparatus of claim 2 wherein said goal detecting means comprises an elongated member positioned behind said goal openings so that a ball passing through one of said goal openings strikes said elongated member to produce an audible sound.

4. The apparatus of claim 1 or 3 wherein said goal boards comprise opposed elastomeric strips for actively rebounding a ball striking one of said goal boards.

5. The apparatus of claim 4 wherein said playing surface and said retaining means are covered with an energy absorbing material to reduce bounding of the ball.

6. The apparatus of claim 5 wherein said energy-absorbing material comprises plastic sheet material.

7. The apparatus of claim 1 further comprising a pair of paddles for each player, each paddle having a handle portion and a striking portion, the striking portion being lined on each side with a depressable covering.

* * * * *